US012679629B2

(12) United States Patent
Kelders et al.

(10) Patent No.: US 12,679,629 B2
(45) Date of Patent: Jul. 14, 2026

(54) METHOD FOR MANUFACTURING A DISPENSER CONTAINER FOR PRESSURIZED FLUIDS AND DISPENSER CONTAINER FOR PRESSURIZED FLUIDS AS MANUFACTURED WITH THIS METHOD

(71) Applicant: JAN KELDERS BEHEER B.V., Elshout (NL)

(72) Inventors: Johannes Hubertus Jozef Maria Kelders, Elshout (NL); Wouter Marius Stinesen, Elshout (NL); Eduard Van Veldhoven, Elshout (NL)

(73) Assignee: JAN KELDERS BEHEER B.V., Elshout (NL)

( * ) Notice: Subject to any disclaimer, the term of this patent is extended or adjusted under 35 U.S.C. 154(b) by 158 days.

(21) Appl. No.: 18/836,102

(22) PCT Filed: Feb. 7, 2023

(86) PCT No.: PCT/NL2023/050053
§ 371 (c)(1),
(2) Date: Aug. 6, 2024

(87) PCT Pub. No.: WO2023/149803
PCT Pub. Date: Aug. 10, 2023

(65) Prior Publication Data

US 2025/0136352 A1 May 1, 2025

(30) Foreign Application Priority Data

Feb. 7, 2022 (NL) ..... 2030830

(51) Int. Cl.
*B65D 83/64* (2006.01)
*B65B 3/04* (2006.01)

(52) U.S. Cl.
CPC ..... *B65D 83/64* (2013.01); *B65B 3/045* (2013.01)

(58) Field of Classification Search
CPC ..... B65D 83/62; B65D 83/64; B65B 3/045
See application file for complete search history.

(56) References Cited

U.S. PATENT DOCUMENTS 3,258,163 A * 6/1966 Brush ..... B67D 1/0412 222/61
3,273,762 A * 9/1966 O'Neill, Jr. ..... B65D 83/64 222/389
3,430,731 A * 3/1969 Satzinger ..... F16N 11/10 239/323
3,813,011 A * 5/1974 Harrison ..... B65D 83/20 222/94

(Continued)

FOREIGN PATENT DOCUMENTS

WO 2020104046 A1 5/2020

*Primary Examiner* — Dariush Seif
(74) *Attorney, Agent, or Firm* — Nath, Goldberg & Meyer; Joshua B. Goldberg

(57) ABSTRACT

The invention relates to a method for manufacturing a dispenser container for pressurized fluids, comprising the steps of providing a cylindrical; a partition wall for separating the internal volume of the cylindrical shell; and a piston; and bringing the partition wall and piston together into the lower part of the cylindrical shell before applying an external indent in the cylindrical shell. The invention further relates to a dispenser container for pressurized fluids as manufactured with this method.

21 Claims, 8 Drawing Sheets

(56) References Cited

Figure 1A:
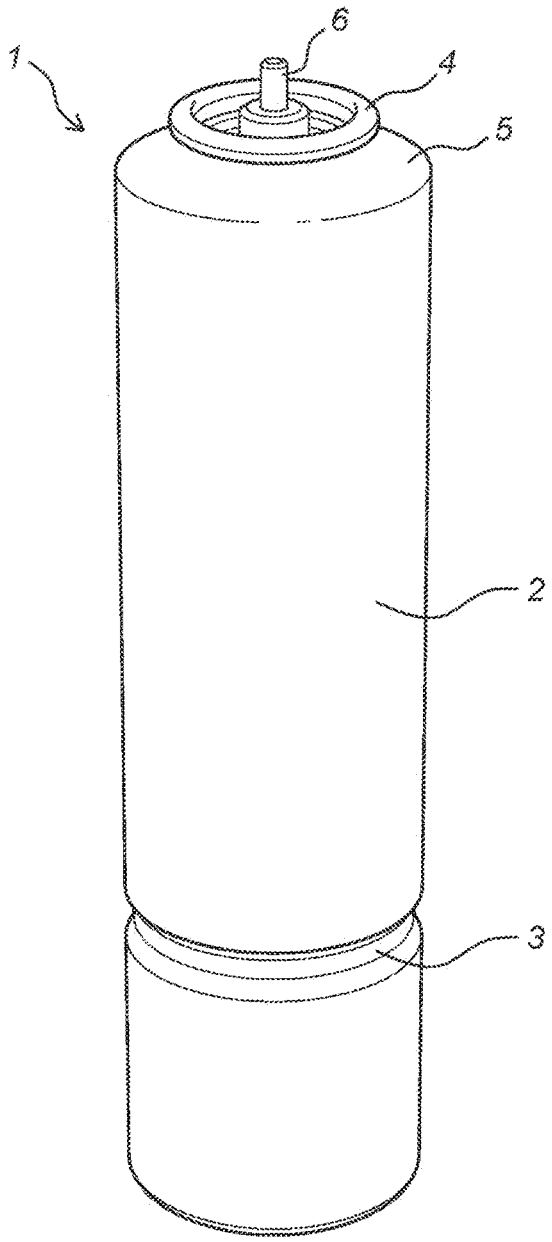

U.S. PATENT DOCUMENTS 3,926,349 A * 12/1975 Schultz ..... B65D 83/64 222/545
3,964,641 A * 6/1976 Langensiepen ..... B65D 51/225 222/525
4,045,938 A * 9/1977 Hansen ..... B65D 83/64 53/470
4,078,359 A * 3/1978 Schultz ..... B65D 83/64 53/489
4,220,261 A * 9/1980 White ..... B65D 81/325 222/320
4,508,244 A * 4/1985 Plaschka ..... B65D 83/64 222/387
4,556,156 A * 12/1985 Frutin ..... B65D 83/64 222/327
4,562,942 A * 1/1986 Diamond ..... B65D 83/62 222/386.5
4,703,875 A * 11/1987 Malek ..... B65D 83/64 92/248
4,896,832 A * 1/1990 Howlett ..... B65D 83/38 239/323
5,042,696 A * 8/1991 Williams ..... B65D 83/75 222/386
5,065,900 A * 11/1991 Scheindel ..... B65D 83/64 222/386
5,133,701 A * 7/1992 Han ..... B65D 83/64 604/289
5,143,259 A * 9/1992 Williams ..... B67D 7/0238 222/389
5,186,361 A * 2/1993 Williams ..... B65D 83/62 222/464.5
5,238,150 A * 8/1993 Williams ..... B65D 83/60 222/386
5,522,526 A * 6/1996 DeLaforcade ..... B65D 83/62 222/387
5,605,259 A * 2/1997 Clawson ..... B65D 83/285 222/402.1
5,865,350 A * 2/1999 Losenno ..... B05B 9/0822 222/105
6,152,335 A * 11/2000 Stern ..... B65D 83/303 222/402.1
6,230,943 B1 * 5/2001 Miyamoto ..... B65D 83/64 222/402.1
6,345,739 B1 * 2/2002 Mekata ..... B65D 83/62 141/3
6,352,184 B1 * 3/2002 Stern ..... B05B 1/1645 222/394
6,431,413 B2 * 8/2002 Corba ..... B65D 83/64 222/402.1
6,499,632 B2 * 12/2002 van't Hoff ..... B65D 83/673 222/399
6,581,806 B2 * 6/2003 Lilienthal ..... B65D 83/64 141/20
6,641,005 B1 * 11/2003 Stern ..... B05B 1/04 222/394
6,789,702 B2 * 9/2004 O'Connor ..... B65D 83/66 222/335
6,874,544 B2 * 4/2005 O'Connor ..... B65D 83/66 141/10
7,014,073 B1 * 3/2006 Stern ..... B65D 83/46 222/394
7,475,797 B2 * 1/2009 Kim ..... A61M 5/14526 222/387
7,481,333 B2 * 1/2009 Goldberg ..... B65D 83/682 222/137
7,481,338 B1 * 1/2009 Stern ..... B05B 1/26 222/394
7,708,171 B2 * 5/2010 Regan ..... B65D 83/673 222/399
8,157,135 B2 * 4/2012 Stern ..... B05D 5/061 222/394
8,960,502 B2 * 2/2015 Stehli, Jr. ..... B65B 7/2842 222/105
9,790,019 B2 * 10/2017 Brouwer ..... B65D 83/20
10,106,311 B2 * 10/2018 Mekata ..... B65D 83/64
10,266,334 B2 * 4/2019 Baker ..... B65D 83/46
10,301,104 B2 * 5/2019 Smith ..... B65D 83/48
10,625,931 B2 * 4/2020 Mekata ..... B65D 83/64
10,947,030 B2 * 3/2021 Baker ..... B65D 83/38
11,020,911 B2 * 6/2021 Brouwer ..... B29C 66/543
11,059,658 B2 * 7/2021 Brouwer ..... B65D 83/64
11,109,849 B2 * 9/2021 Jensen ..... A61M 5/145
11,358,783 B2 * 6/2022 Baker ..... B65D 83/48
11,661,267 B2 * 5/2023 Kelders ..... B65D 83/673 222/145.5
11,851,264 B2 * 12/2023 Vanderstraeten ..... B65D 83/44
11,866,248 B2 * 1/2024 Baker ..... B65D 83/48
12,312,152 B2 * 5/2025 Kloebbe ..... B65D 83/64
2003/0102328 A1 * 6/2003 Abplanalp ..... B65D 83/48 222/402.1
2004/0134929 A1 * 7/2004 Scheindel ..... B65D 83/64 222/402.1
2007/0125809 A1 * 6/2007 Regan ..... B65D 83/64 222/399
2008/0083776 A1 * 4/2008 Gupta ..... B65D 83/64 141/3
2008/0116228 A1 * 5/2008 Ryan ..... B65D 83/673 222/402.1
2009/0283550 A1 * 11/2009 Kimball ..... B65D 83/64 222/387
2013/0168413 A1 * 7/2013 Bodet ..... B65D 83/64 141/2
2015/0076164 A1 * 3/2015 De Cuyper ..... B65D 11/04 220/721
2015/0122836 A1 * 5/2015 Bodet ..... B05B 11/028 222/136
2016/0145034 A1 * 5/2016 Laidler ..... B65D 83/36 222/189.1
2017/0327300 A1 * 11/2017 Brouwer ..... B29C 65/1635
2018/0370150 A1 * 12/2018 Brouwer ..... B29C 65/1667
2021/0101738 A1 4/2021 Vanderstraeten et al.
2021/0130079 A1 * 5/2021 Olberding ..... B65D 83/64
2021/0188527 A1 * 6/2021 Risch ..... B65D 83/425
2022/0009702 A1 * 1/2022 Kelders ..... B65D 83/673
2024/0208156 A1 * 6/2024 Van Doorn ..... B29C 49/08
2025/0136352 A1 * 5/2025 Kelders ..... B21D 51/26
2025/0187816 A1 * 6/2025 Greiner-Perth ..... B65D 83/164

* cited by examiner

METHOD FOR MANUFACTURING A DISPENSER CONTAINER FOR PRESSURIZED FLUIDS AND DISPENSER CONTAINER FOR PRESSURIZED FLUIDS AS MANUFACTURED WITH THIS METHOD

This is a National Phase Application filed under 35 U.S.C. 371 as a national stage of PCT/NL2023/050053, filed Feb. 7, 2023, an application claiming the benefit of Netherlands Application No. 2030830, filed Feb. 7, 2022, the content of each of which is hereby incorporated by reference in its entirety.

The invention relates to a method for manufacturing a dispenser container for pressurized fluids, having a cylindrical shell with a bottom and a partition wall for separating the internal volume of the container into a high-pressure chamber and a fluid chamber. The invention also relates to a dispenser container for pressurized fluids as manufactured with such a method.

Containers for pressurized dispensers fulfil multiple functions, including containing a fluid to be dispensed, and maintaining an overpressure inside the container for dispensing of the fluid contained inside the container. A well-known problem with common dispensers is that the pressure at which the fluid to be dispensed is contained, changes over time, due to the leakage of propellant from the container as well as the deceasing level of the fluid to be dispensed because of normal use of the dispenser. Although in common household applications—such as personal care products, paint, glue, and so on—a variation in pressure may be acceptable, other applications including the dispensing of high viscous substances such as sealants or caulks, or applications in a medical context, require accurate dosing control. However, in all applications a continuous pressure over the lifetime of the dispenser containers is preferred.

To guarantee a constant and predictable outflow of fluid over the lifetime of the dispenser, the pressure prevailing in fluid to be dispensed should thus be kept constant. More advanced dispenser containers are therefore pressure controlled, for which they are provided with a compartment containing a highly pressurized propellant. The compartment is furthermore provided with a pressure control valve that controls the outflow of propellant from the compartment based on the pressure prevailing in the fluid to be dispensed, thereby keeping the fluid to be dispensed at a constant pressure.

Also know from the international patent application WO2020/104046 is to use a partition wall including a pressure valve to separate the inside of the cylindrical metal shell of the dispenser container in two compartments; a high-pressure chamber and a fluid compartment holding the fluid to be dispersed. Pressurized gas leaves the high-pressure compartment via the pressure valve and exerts its pressure on a piston that is moveable allocated in the fluid compartment. WO2020/104046 discloses the fixation of the partition wall in the cylindrical metal shell of the dispenser container by deformation of the cylindrical metal shell so that in the inside of the cylindrical shell a protrusion arises against which protrusion the partition wall abuts.

A drawback related to manufacturing of such partition wall separated dispenser containers is that assembly of such containers is complex, and it is difficult to meet the high demand on the dimensional accuracy. Furthermore, is the manufacturing process time consuming, which leads to relative high production costs.

It is therefore an object of the present invention to provide a method for manufacturing a dispenser container that enables to manufacturing of dispenser container with higher dimensional accuracy and at lower costs than according to the prior art, as well as to provide an improved dispenser container with enhanced properties such as strength and durability.

The present invention thereto provides a method for manufacturing a dispenser container for pressurized fluids, comprising the steps of: A) providing a cylindrical shell with a bottom and an open top, forming at least part of the outer wall of the dispenser container; B) providing a partition wall for separating the internal volume of the cylindrical shell into a high-pressure chamber and a fluid chamber, with a valve mounted into the partition wall; C) providing a piston to be moveably positioned in the fluid chamber; D) bringing the partition wall and the piston together into the lower part of the cylindrical shell; E) after step D) applying at least one external indent in the cylindrical shell, which indent extends as a protrusion into the internal volume of the cylindrical shell; whereby the partition wall is located at the height where the external indent is applied or whereby the partition wall and the piston are located on the bottom side in the cylindrical shell of the location where the external indent is applied. The partition wall may also referred to as a "divider". As the partition wall separates the high-pressure chamber from the fluid chamber, and only the valve in the partition wall must release on a pressure-controlled way the gas from the high-pressure chamber to the fluid chamber, the partition wall must fit gastight to the inner wall of the cylindrical shell.

Such a gastight may be realised by initially producing the indent in the cylindrical shell under the condition that the shape and dimensions of the internal protrusion(s) in the cylindrical shell and the shape and dimensions of the partition wall are matching. The at least one indent forms at least part of the sealing zone. Said indent may hereby act as an abutment or indexing surface for the partition wall, such that the partition wall will be placed in the correct position inside the cylindrical shell. The gastight connection between the cylindrical shell and the partition wall may be realised—in case the partition wall is located at the height where the external indent is applied—directly by the gastight fit of the indentation (the protrusion on the inside of the cylindrical shell) with the co-acting partition wall, or—in case the partition wall and the piston are located on the bottom side in the cylindrical shell of the location of the external indentation—subsequently by applying a sufficient pressure between the bottom part of the cylindrical shell and the partition wall forcing the partition wall and piston towards and against the indentation, which indentation is a protrusion on the inside of the cylindrical shell until the at least one indent in the cylindrical shell and the partition wall meet each other to form a (e.g. snap-fit) joint guaranteeing a correct placement of the partition wall inside the cylindrical shell.

An important advantage of bringing the partition wall and the piston together into the cylindrical shell is that only a single handling is required to both introduce the partition wall and the piston in the cylindrical shell. Yet a further advantage is that the invention enables the allocation of the partition wall and piston on a lower position in the cylindrical shell before applying at least one external indent (resulting in an internal protrusion) thus allowing an "opposing tool" into the cylindrical shell that absorbs the pressure exerted on the outside of the cylindrical shell to realise the external indentation, or—as an alternative—to allocate the partition wall on the location where the indentation is provided such that the partition wall absorbs the pressure exerted on the outside of the cylindrical shell to realise the external indentation. In both the situations the pressure exerted on the outside of the cylindrical shell will be absorbed without the risk of deformation of the cylindrical shell except for the indentation to be made.

Typically, the partition wall connects to the cylindrical shell in a form-fitting manner, meaning that the partition wall follows the contours of the cylindrical shell over at least the part where the partition wall connects to the cylindrical shell. The form-fitting connection between the partition wall and the cylindrical shell hereby aids in obtaining a fluid-tight seal. The seal created between the partition wall and the cylindrical shell should typically be fluid tight to at least $8 \cdot 10^5$ Pa, preferably to at least $10 \cdot 10^5$ Pa, and more preferably to at least $15 \cdot 10^5$ Pa.

In case the partition wall and piston are located on a lower position in the cylindrical shell before applying at least one external indent the partition wall may—after applying sufficient pressure—pushed against the internal protrusion, during which movement the partition wall will carry along the piston and even will press the piston (under the condition that the piston is sufficiently flexible) over the at least one protrusion on the inner cylindrical shell wall. This also limits the number of production steps and thus simplifies and shortens the manufacturing of the dispenser container.

Yet another advantage of the method for manufacturing a dispenser container according to the present invention wherein the partition wall and piston are located on a lower position in the cylindrical shell before applying at least one external indent is that it enables applying the indent in the cylindrical shell while there is access from both the inside and the outside of the cylindrical shell to the location where the indent I to be made. This allows to use two co-operating mould parts (an external mould part and an internal mould part) thus making it far easier to quick and with well controlled dimensions to apply the at least one indent. This is also advantageous for the quality of the final product (the dispenser container) as the dimensional accuracy of the indent (and thus of the at least one internal protrusion) is important to realise a gas tight fit of the partition wall and the inner wall of the cylindrical shell wall. A further advantage of access from two sides to the location(s) where the indent must be made is that this allows to accelerate the process of applying the indent (and thus shortens the production cycle).

Also in case the partition wall will be provided on the location where the indentation is so that the partition wall absorbs the pressure exerted on the outside of the cylindrical shell also deformation of the cylindrical shell due to the external force exerted on it will be prevented as the partition wall will support the cylindrical wall. Furthermore due to the pressure exerted the internal protrusion that will be realised in the cylindrical shell will directly position and hold the partition wall in its final position thus even further limiting the number of production steps required for manufacturing of the dispenser container. In this situation the piston will be on top of the partition wall thus also in its desired functional position.

The cylindrical shell may be embodied as a cylindrical metal shell, including aluminium, steel and tin plate, but alternatively also other materials like plastics or composite materials may be used. An advantage related to the use of a cylindrical metal shell is that, compared to plastics, metal generally has a low permeability to propellant gasses and fluids contained within the dispenser container as well as moisture to which the outside of the cylindrical metal shell is exposed. Furthermore, metal offers a superior protection against UV-radiation compared to plastics. As a result, in general the dispenser according to the present invention provided with a cylindrical metal shell will have a longer shelf life compared to plastic dispenser counterparts. Moreover, metals are resistant to the corrosive action of various chemicals where plastics might not be, allowing the cylindrical metal shell dispenser container to contain different types of dispensable fluids than its plastics counterparts. It is possible that the material of the partition wall corresponds to the material of the cylindrical shell. The choice of material for the partition wall may include any suitable material, not necessarily being metal. For example, the partition wall may be made from a plastic, such as polyethylene terephthalate (PET), or a combination of plastics. It is moreover possible that the partition wall is made from a composite material, comprising a combination of different types of materials. In addition, the partition wall may comprise several layers of the same or different materials that together form a laminate.

For a firm fixation of the partition wall the external indent applied during process step E) fully around the circumference of the outer wall of the cylindrical shell, thus providing a circumferential protrusion into the internal volume of the cylindrical shell (fully around a circumference of the outer wall of the container). In such embodiment the surface area of the sealing zone over which the partition wall connects to the cylindrical shell is relative large, which benefits the quality and strength of the seal.

In the situation that the partition wall and the piston are located on the bottom side in the cylindrical shell of the location where the external indent is applied the external indent may be applied in the outer wall of the cylindrical shell during process step E) using an external pressure element and an internal counter-pressure (backpressure) element. Such "dual tool" forming process may lead to a highly controlled process result (an accurate dimensioning of the indent(s)) and may also prevent any substantial forces to result forming the forming process then on the exact location of deformation of the cylindrical shell.

After applying at least an external indent in the cylindrical shell of the dispenser, a top end of the cylindrical shell opposing a bottom of the cylindrical shell may be formed into a neck portion, for instance configured for connection with an outlet valve. The connection between the outlet valve and said neck portion may hereby be accomplished by providing a thread on the neck portion and the outlet valve. As the top end of the dispenser container commonly functions as a fill opening for filling the dispenser container with a dispensable fluid, the outlet valve is commonly placed (screwed) on top of the dispenser container after filling the dispenser container with the fluid to be dispensed.

Before process step D) the partition wall and the piston may be assembled as a single divisible part. If the partition wall and the piston are combined as a single part the handling of such combination into the lower part of the cylindrical shell during process step D) is simplified as the parts may be handled as a single unit. The piston—when arrived in its working position—separates the fluid chamber into:—a first pressure gas filed compartment extending between the partition wall and the piston, and—a second dispensable fluid filled compartment bordering a side of the piston facing away from the first compartment.

In the situation that the partition wall is located at the height the external indent is applied during processing step E) the indent fits a corresponding recess in the partition wall. The advantage of this alternative production method according to the invention is that two process steps may be combined as one. Besides applying the at least one indent in the cylindrical shell, during the same step also the partition wall is fixed in its final position. Displacing the partition wall in the cylindrical shell after the at least one indent has been applied is now superfluous.

In the situation that the partition wall and the piston during processing step E) are located on the bottom side in the cylindrical shell of the location where the external indent is applied in a subsequent method step F) a pressure is applied between the bottom and the partition wall forcing the partition wall and piston towards the protrusion thereby moving the piston beyond the protrusion and forcing the partition wall against the protrusion, preferably directly providing a gastight connection between the partition wall and the cylindrical shell. An advantage of this alternative method according to the present invention is that the positioning of the partition wall and the piston in the cylindrical shell requires less accuracy and thus the production process is less prone to errors. Subsequently during process step F) a pressure, for instance a gas pressure, may be applied between the bottom and the partition wall via an opening in the bottom of the cylindrical shell, which pressure is intended to displace the partition wall away from the bottom of the cylindrical shell until the partition wall is urged against the at least one protrusion in the wall of the cylindrical shell. During this process step F) the piston may be temporarily distorted to move beyond the internal protrusion of the cylindrical shell, and after passing the protrusion the piston restores itself to its original state, abutting the inner surface of the cylindrical shell. Such temporarily distortion enables to move the piston over the protrusion in the cylindrical shell. To ensure a (gas) tight fitting of the partition wall with the cylindrical shell the shape of the partition wall preferably fits the shape of the internal protrusion of the cylindrical shell.

Step A) may comprises deep drawing a blank (slug) wherein a punch is driven, thus forming a cylindrical shell consisting as a single integral part having a bottom and a side wall. Alternatively, step A) may comprise transforming a sheet into a tubular side wall wherein two adjacent edges of the sheet are connected with a seam, and subsequently connecting a separate bottom to a bottom end of the tubular side wall.

For a quick and simple filling of the fluid chamber the fluid chamber may be filled through the neck portion with a fluid to be dispensed, after which an outlet valve may be connected to the neck portion.

The present invention also provides a dispenser container for pressurized fluids as manufactured with the method according to the present invention and as disclosed above. In a specific embodiment an outer side of the cylindrical shell may be provided with an annular indent surrounding the cylindrical shell.

The partition wall may have an at least partly convex shape, extending at least partly past the sealing zone into the low-pressure chamber. Alternatively, the partition wall may have an at least partly concave shape, extending at least partly past the sealing zone into the high-pressure chamber. Specifically, the partition wall may in either case be (partly) dome-shaped, wherein the partition wall projects radially inwards in a gradual fashion. The convex or concave shape may hereby aid in reducing the internal loads in the partition wall as a result of the forces being exerted thereon due to the pressure difference existing over the opposing sides of the partition wall.

The partition wall may comprise a rim area extending in a direction parallel to the metal shell, wherein at least part of the rim area forms part of the sealing zone. Said rim area may be used to increase the surface over which the sealing zone extends along the partition wall and therewith along the metal shell. This benefits the quality of the seal. In a specific embodiment the partition wall may comprise a rim area provided with a slot that fits the indent in the cylindrical shell.

In another embodiment of the dispenser container according to the invention, the valve mounted into the partition wall may be a constant pressure release valve, configured for releasing fluid from the high-pressure chamber to the fluid chamber at a constant pressure. In other words: the constant pressure release valve is configured for regulating the pressure difference between the high-pressure chamber and the fluid chamber to ensure a constant pressure inside the fluid chamber, independent of the pressure inside the high-pressure chamber, given that the pressure in the high-pressure chamber exceeds the pressure in the fluid chamber.

The valve may, in addition to being configured for a controlled release of fluid from the high-pressure chamber to the fluid chamber, be configured as a filling valve allowing the pass-through of a fluid to the high-pressure chamber. This allows the high-pressure chamber to be filled with a propellant without the need for an additional filling valve. Alternatively, the cylindrical shell may be provided with a dedicated filling valve connecting to the high-pressure chamber. Said dedicated filling valve hereby does not function as a pressure regulating valve but only functions as a one-way valve allowing the pass-through of a propellant towards the high-pressure chamber. In a typical instance, the dedicated filling valve is provided in the bottom of the dispenser, opposing a dispensable fluid fill opening typically present at a top end of the dispenser container. The dedicated filling valve allows the dispenser to be filled with propellant in a finished state of the dispenser container, even after filling of the container with the fluid to be dispensed.

The piston may be configured for a substantially fluid-tight separation between the first and second compartment, which is especially important in the case the dispensable fluid has a low viscosity. For fluid-tight connection with dispenser container wall, the piston typically abuts the internal wall of the cylindrical shell. The second compartment commonly extends between the piston and the top end of the dispenser container, such that the second compartment connects to the outlet valve once the outlet valve is placed on said top end of the dispenser container. The first compartment typically contains a propellant under low-pressure, being a pressure smaller than the pressure prevalent in the high-pressure chamber but a pressure higher than the environmental (outside) pressure. The second compartment typically contains a fluid to be dispensed, in which fluid the prevailing pressure is approximately similar to the pressure in the first compartment. Such a separation of the (low-pressure) propellant and the dispensable fluid is particularly useful in case the fluid to be dispensed has a high viscosity. The piston hereby guarantees a proper dispensing of the dispensable fluid. The surface of the piston facing the partition wall preferably has a shape that—at least partly—corresponding to the contours of adjacent side of the partition wall.

It the position where the piston at least partly abuts the partition wall, for instance while bringing the partition wall and the piston together into the lower part of the cylindrical shell, a space may be left between the piston and the partition wall. This space functions as a buffer volume that contributes to the stability and proper functioning of the valve such that a controlled release of fluid from the high-pressure chamber to the fluid chamber takes place in case fluid is dispensed from the second compartment.

Filling of the dispenser container with the propellant and the fluid to be dispensed is typically performed after assembling the dispenser container. It is also possible that the high-pressure chamber is sealed off from the environment in a pressure chamber containing pressurized propellant. The propellant is hereby enclosed inside the high-pressure chamber during assembly, such that a separate filling step is foregone, and no propellant filling valve needs to be incorporated into the dispenser container. The top end of the dispenser container commonly functions as a fill opening for filling the dispenser container with a dispensable fluid and is therefore left open till after the dispenser container is filled with said dispensable fluid. Any outlet valve is then placed on top of the dispenser container after filling the dispenser container with the fluid to be dispensed.

Figure 1B:
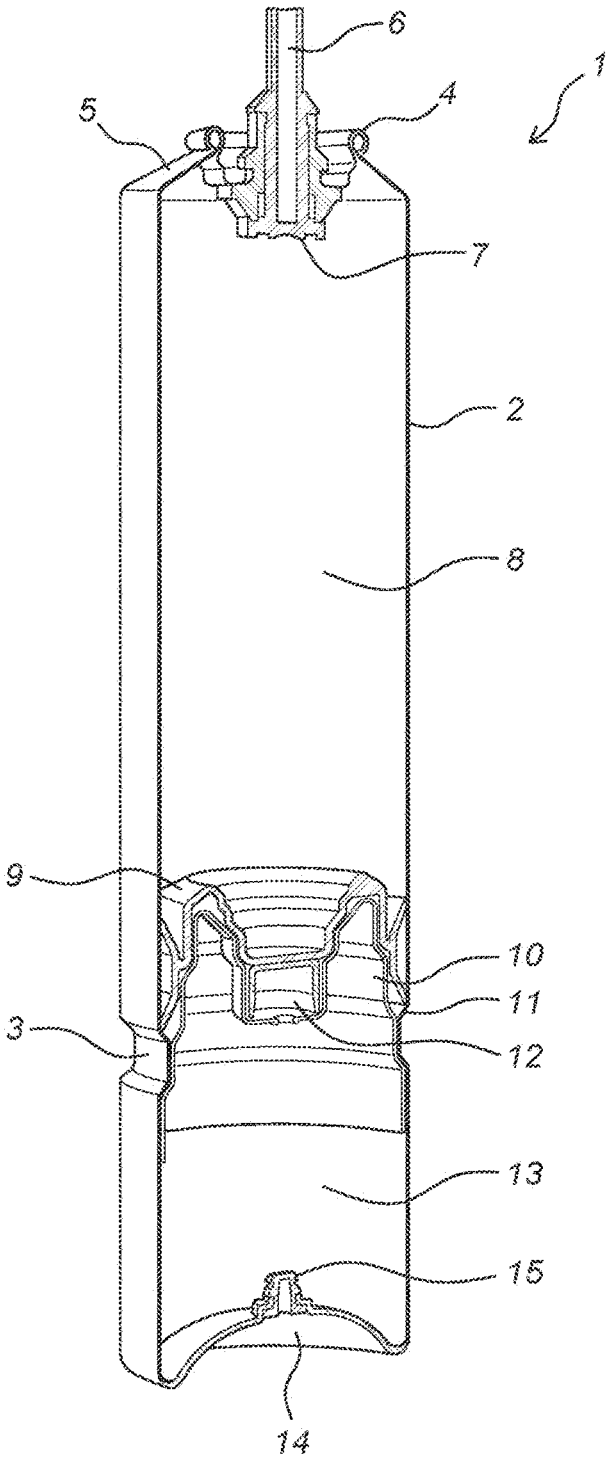
Figure 2:
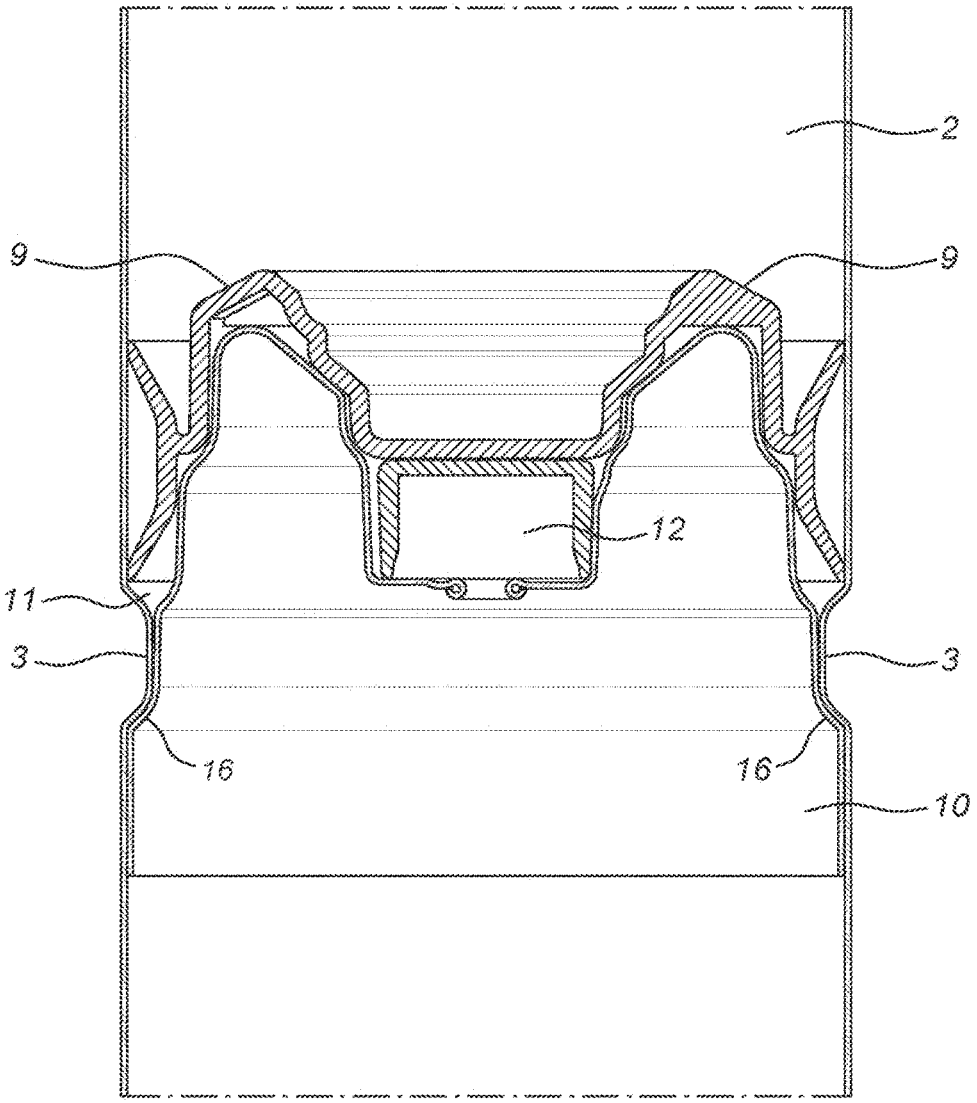
Figure 3A:
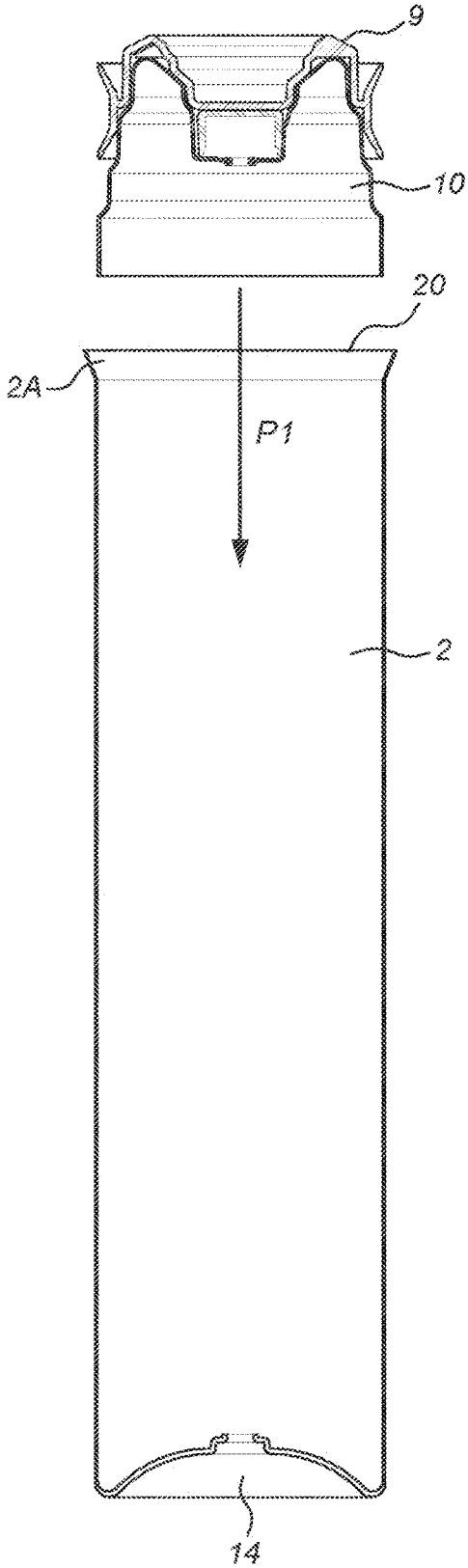
Figure 3B:
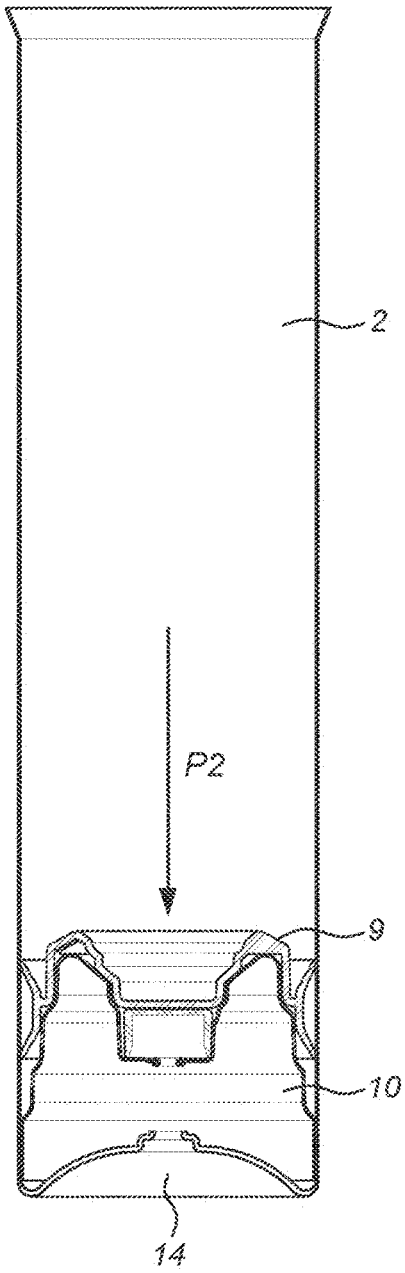
Figure 3C:
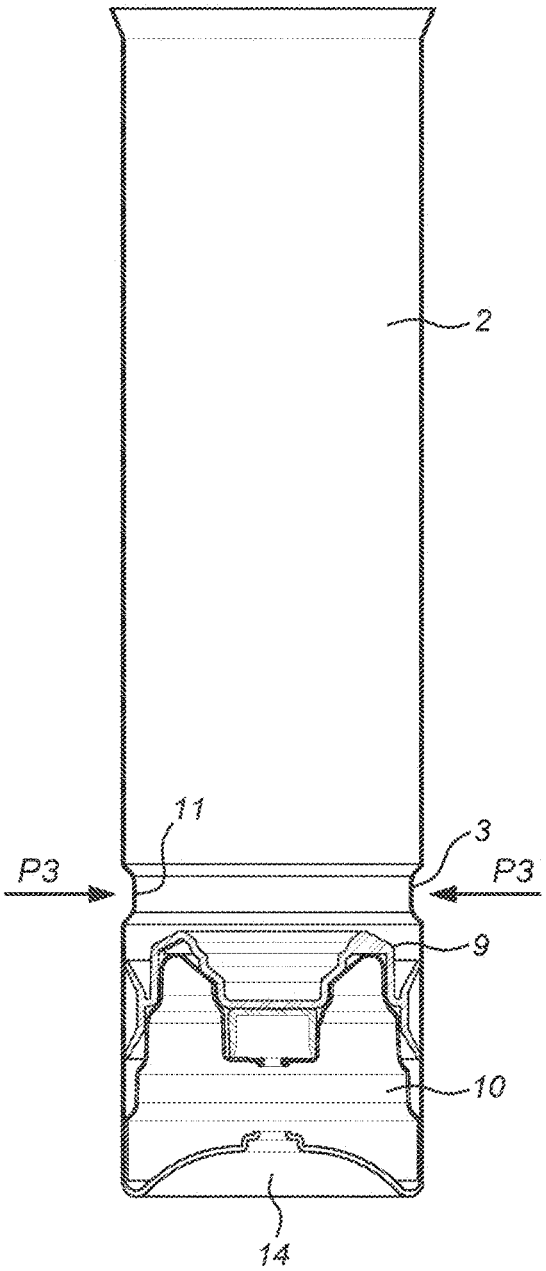
Figure 3D:
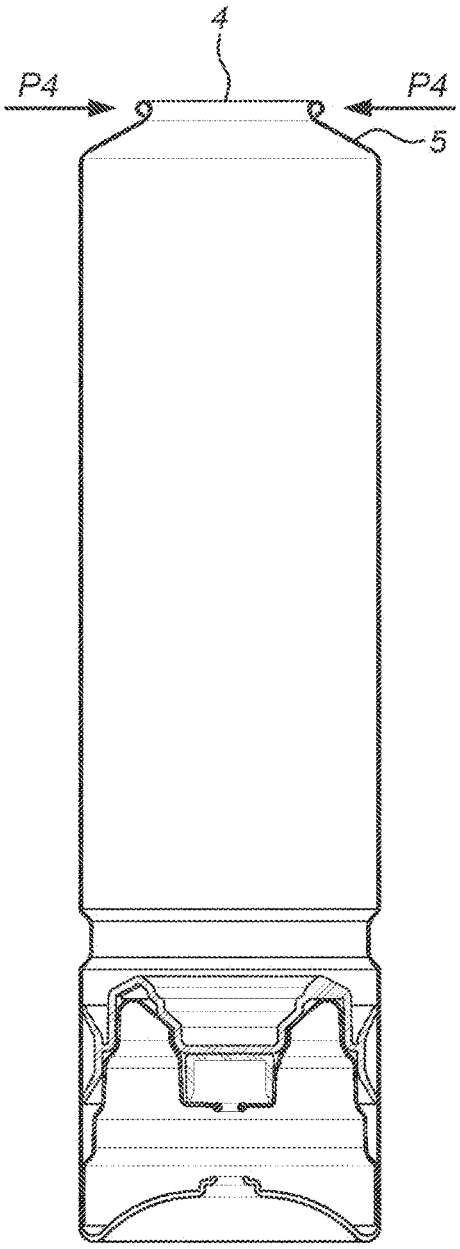
Figure 3E:
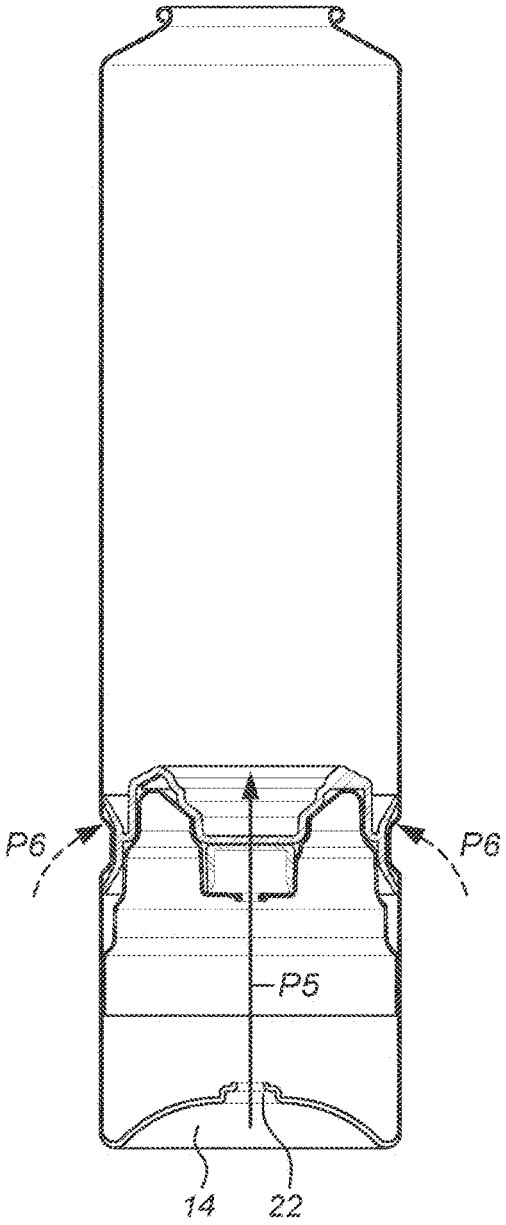
Figure 3F:
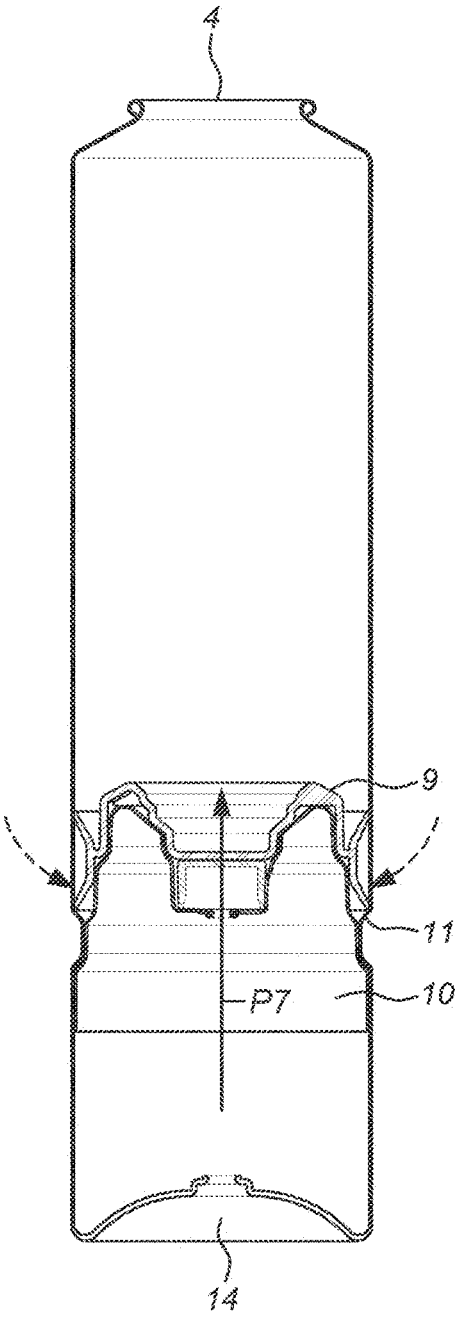
Figure 4:
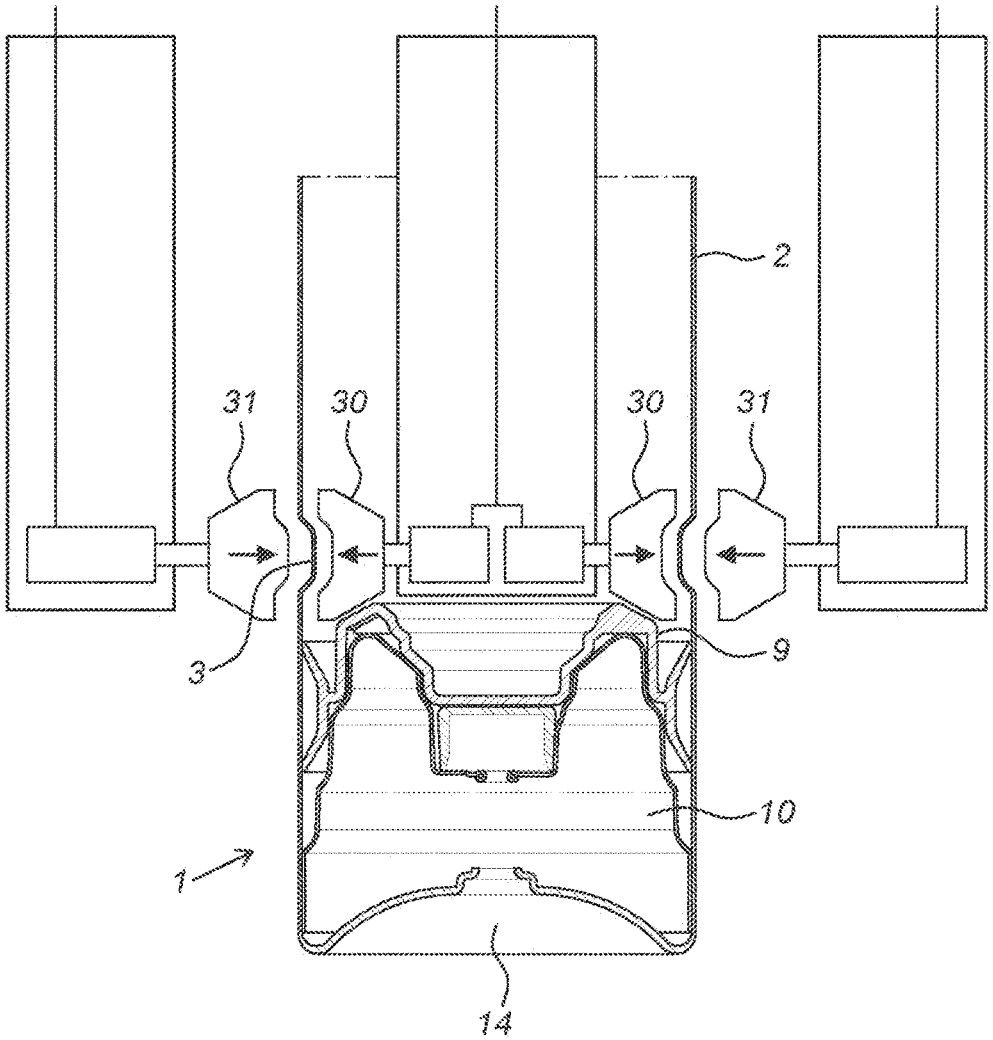
Figure 5:
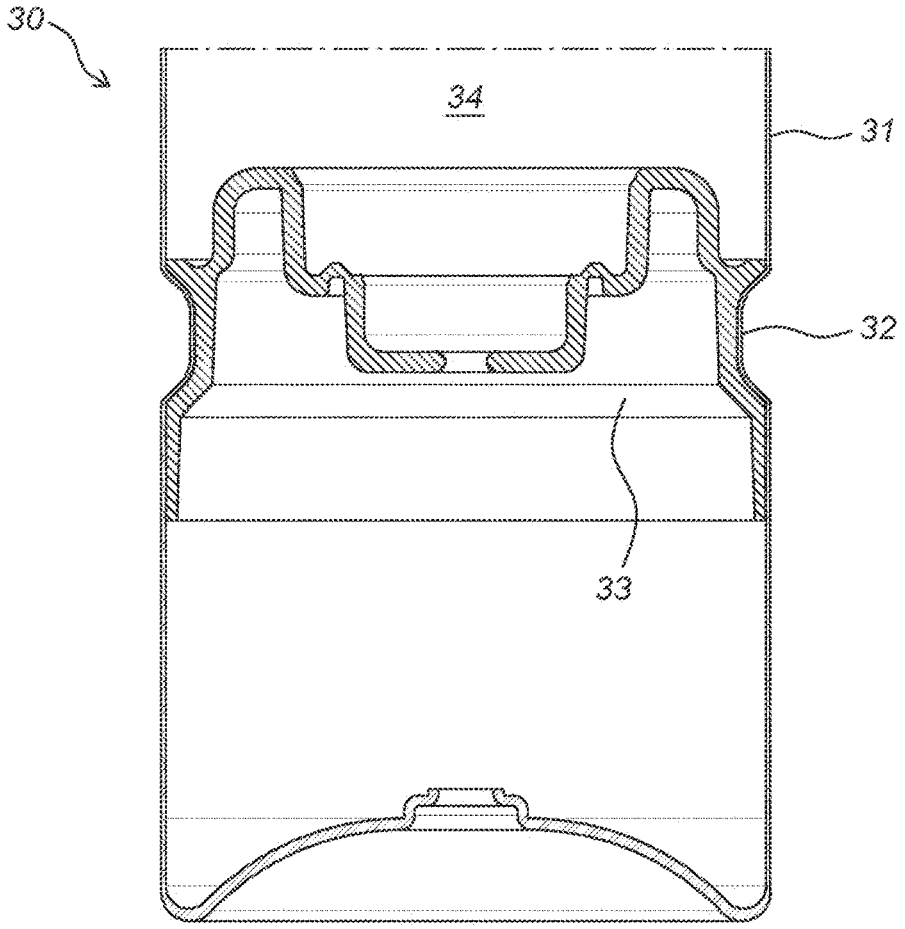

The invention will now be elucidated with reference to the non-limitative exemplary embodiments illustrated in the following figures. Corresponding elements are denoted in the figures by corresponding reference numbers. Herein shows:

FIG. 1A a perspective external view on a dispenser container manufactured with the method according to the invention, FIG. 1B a longitudinal cross-section of the dispenser container as shown in FIG. 1A, FIG. 2 a cross-section of a detail of a dispenser container manufactured with the method according to the invention showing a part of the cylindrical shell with indent, a partition wall, and a piston, FIGS. 3A-3F longitudinal cross-sections of subsequent phases of manufacturing process of a dispenser container according to the method of the present invention, FIG. 4 schematic detailed view on the method step of applying at least an external indent in the cylindrical shell of the dispenser, and FIG. 5 a longitudinal cross-section of the bottom part of an alternative embodiment of the dispenser container according to the invention.

FIG. 1A shows a perspective external view on a dispenser container 1 manufactured with the method according to the invention in a final state. The cylindrical shell 2 of the container 1 is provided with a circumferential indention 3 and on the outfeed (upper) side of the container a neck 4 and shoulder 5 are applied with a central outlet tube 6 that may be connected to a—not shown here—spray nozzle.

FIG. 1B shows a longitudinal cross-section of the dispenser container 1 from FIG. 1A. On the outfeed side the outlet tube 6 connects to an outlet valve 7. The upper side of the circumferential indention 3 the cylindrical shell 2 borders a fluid compartment 8, in which fluid compartment a piston 9 is allocated. By a movement of the piston 9 towards the outlet tube 6 a fluid the fluid compartment 8 will be placed under pressure enabling the outlet valve 7 to release a portion of the fluid to be dispersed. The piston 9 connects seamlessly but moveable to the inner cylindrical shell wall 2 preventing fluid to pass the piston 9 towards a partition wall 10. The partition wall 10 connects gastight to an internal protruding rim (protrusion) 11, that corresponds with the external circumferential indention 3 shown in FIG. 1A. In the partition wall a constant pressure release valve 12 is placed that is the only opening for gas to pass from a high-pressure gas chamber 13 on the opposite side of the partition wall 10 than the fluid chamber 8. The high-pressure gas chamber 13 functions as a reservoir for a (highly) compressed propellant. Suitable propellants include propane, butane, carbon dioxide, nitrogen, air or any other suitable substance. Preferably, a propellant is chosen that does not chemically react with the dispensable fluid. The cylindrical shell 2 also comprises a bottom 14. In the depicted case, the cylindrical shell 2 and the bottom 14 are formed as a single, integral part. The bottom 14 is provided with another valve or releasable closing 15, enabling to pressurize the high-pressure chamber 13 but also supportive in the manufacturing process as will be illustrated later.

In FIG. 2 the piston 9, partition wall 10 and the external circumferential indention 3 as shown in FIG. 1B. A contour 16 of the partition wall 7 is formfitting to the internal protruding rim 11 which is not only providing mechanical support to the partition wall 7 but also leads to a gastight abutting of the partition wall 7 onto the internal protruding rim 11. The contact between the partition wall 7 and the internal protruding rim 11 increase the contact area and is thus further supportive in providing a gastight contact. The protruding rim 11 (and thus also the indention 3) typically extends fully around a circumference of the wall of the cylindrical shell 2 of the container 1 to maximally benefit the quality of the seal between the cylindrical shell 2 and the partition wall 7. The piston 9 will engage the internal wall of the cylindrical shell 2 under pretension, for which the piston 9 may be made from a flexible material, such as high-density polyethylene (HDPE).

FIGS. 3A-3F show longitudinal cross-sections of subsequent phases of manufacturing process of a dispenser container 1 according to the method of the present invention. In FIG. 3A in the cylindrical shell 2, having a bottom 14 and an open top 20 is shown, wherein the open top 20 has a widened edge 21 to support easy assembly. According to arrow $P_1$ the combined partition wall 10 and piston 9 are brought into the cylindrical shell 2. As is shown in FIG. 3B the combined partition wall 10 and piston 9 are fed downwards (arrow $P_2$) into a lower part of the cylindrical shell 2 close to the bottom 14. Subsequently, as shown in FIG. 3C a circumferential external indention 3 is made in the cylindrical shell 2 (according to arrows $P_3$). Hereby the partition wall 10 and the piston 9 are located on the bottom side 14 in the cylindrical shell 2 of the location where the external indent 3 is made; the partition wall 10 and the piston 9 are thus both below the external indent 3 (that corresponds to the internal protruding rim 11). Then a neck 4 and shoulder 5 are applied as illustrated with arrows $P_4$ in FIG. 3D.

After this step of FIG. 4D (gas) pressure is applied according to arrow $P_5$ via an opening 22 in the bottom 14, which is illustrated in FIG. 4E. (As shown in FIG. 1B this opening 22 in the bottom 14 will later be closed by a valve or releasable closing 15.) By applying this (gas) pressure the partition wall 10 and the piston 9 are moved away from the bottom 14 until the partition wall 10 abuts and form fits the internal protruding rim 11 (see FIG. 4F). The piston 9 however is moved upwards more than the partition wall 10 and will pass the internal protruding rim 11 which is only possible when the piston 9 is compressed (see the dotted lines $P_6$ in FIG. 3E). After passage of the internal protruding rim 11 by the piston 9 (which further movement of the piston 9 is illustrated with arrow P7) the piston 9 will get wider again and will return to its initial state as illustrated in the FIGS. 3B-3D. The piston 9 is thus made from a flexible material. The dispenser container 1 is now ready to be filled with fluid and pressure gas and to be closed on the bottom side 14 and on the neck side 4.

FIG. 4 schematic shows the applying the detailed view on the method step of applying at least an external indent 3 in the cylindrical shell 2 of the dispenser 1. The piston 9 and the partition wall 10 are located on the bottom side 14 in the cylindrical shell 2 of the location where the external indent 3 is made. This specific positioning of the piston 9 and the partition wall 10 (see also FIG. 3C) enables access to internal forming tools 30 and external forming tools 31 form both sides is the cylindrical shell 2. This enables a well-controlled application of the external indent 3 as the forces exerted on the cylindrical shell 2 may be balanced.

FIG. 5 shows a longitudinal cross-section of the bottom part of an alternative embodiment of the dispenser container 30 according to the invention manufactured with the method according to the invention in a state wherein an cylindrical shell 31 of the dispenser container 30 is provided with a circumferential indention 32 that form-fitting cooperates with a partition wall 33. A piston to be allocated in a fluid compartment 34 is not illustrated here as this figure focusses on the attachment of the partition wall 33 in the cylindrical shell 31. During the manufacture of this dispenser container 30 the partition wall 33 is located at the height where the external indent 32 is applied and thus with the deformation of the cylindrical shell the partition wall is automatically also (fluid-tight) attached in the dispenser container 30.

It should be clear that the invention is not limited to the exemplary embodiments Illustrated.

The invention claimed is:

1. Method for manufacturing a dispenser container for pressurized fluids, comprising the steps of:

A) providing a cylindrical shell with a bottom and an open top, forming at least part of the outer wall of the dispenser container;

B) providing a partition wall for separating the internal volume of the cylindrical shell into a high-pressure chamber and a fluid chamber, with a valve mounted into the partition wall;

C) providing a piston to be moveably positioned in the fluid chamber;

D) bringing the partition wall and the piston together into the lower part of the cylindrical shell; and E) after step D) applying at least one external indent in the cylindrical shell, which indent extends as a protrusion into the internal volume of the cylindrical shell; whereby the partition wall is located at the height where the external indent is applied or whereby the partition wall and the piston are located on the bottom side in the cylindrical shell of the location where the external indent is applied.

2. Method for manufacturing a dispenser container for pressurized fluids according to claim 1, characterized in that the external indent is applied during process step E) fully around the circumference of the outer wall of the cylindrical shell, thus providing a circumferential protrusion into the internal volume of the cylindrical shell.

3. Method for manufacturing a dispenser container for pressurized fluids according to claim 1, characterized in that the external indent is applied in the outer wall of the cylindrical shell during process step E) using an external pressure element and an internal counter-pressure (backpressure) element.

4. Method for manufacturing a dispenser container for pressurized fluids according to claim 1, characterized in that after processing step E) the open top of the cylindrical shell is partially closed by applying a neck and shoulder.

5. Method for manufacturing a dispenser container for pressurized fluids according to claim 1, characterized in that before process step D) the partition wall and the piston are assembled as a single divisible part.

6. Method for manufacturing a dispenser container for pressurized fluids according to claim 1, characterized in that when the partition wall is located at the height the external indent is applied during processing step E) the indent fits a corresponding recess in the partition wall.

7. Method for manufacturing a dispenser container for pressurized fluids according to claim 1, characterized in that when the partition wall and the piston during processing step E) are located on the bottom side in the cylindrical shell of the location where the external indent is applied in a subsequent method step F) a pressure is applied between the bottom and the partition wall forcing the partition wall and piston towards the protrusion thereby moving the piston beyond the protrusion and forcing the partition wall against the protrusion.

8. Method for manufacturing a dispenser container for pressurized fluids according to claim 7, characterized in that during process step F) a pressure, for instance a gas pressure, is applied between the bottom and the partition wall via an opening in the bottom of the cylindrical shell.

9. Method for manufacturing a dispenser container for pressurized fluids according to claim 7, characterized in that during process step F) the piston is temporarily distorted while moving beyond the internal protrusion of the cylindrical shell, and after passing the protrusion the piston restores itself to its original state, abutting the inner surface of the cylindrical shell.

10. Method for manufacturing a dispenser container for pressurized fluids according to claim 1, characterized in that the shape of the partition wall fits the shape of the internal protrusion of the cylindrical shell.

11. Method for manufacturing a dispenser container for pressurized fluids according to claim 1, characterized in that step A) comprises deep drawing a blank wherein a punch is driven into the blank, thus forming a cylindrical shell consisting as a single integral part having a bottom and a side wall.

12. Method for manufacturing a dispenser container for pressurized fluids according to claim 1, characterized in that the fluid chamber is filled through a neck portion with a fluid to be dispensed, after which an outlet valve is connected to the neck portion.

13. Dispenser container for pressurized fluids as manufactured with the method according to claim 1.

14. Dispenser container according to claim 13, characterized in that the partition wall has an at least partly convex shape, extending at least partly past a sealing zone into the fluid chamber.

15. Dispenser container according to claim 13, characterized in that the partition wall comprises a rim area extending in a direction parallel to the cylindrical shell.

16. Dispenser container according to claim 15, characterized in that an outer side of the cylindrical shell is provided with an annular indent surrounding the cylindrical shell.

17. Dispenser container according to claim 13, characterized in that the partition wall comprises a rim area provided with a slot that fits the indent in the cylindrical shell.

18. Dispenser container according to claim 13, characterized in that the valve is a constant pressure release valve configured for releasing gas at a constant pressure from the high-pressure chamber to the space in the fluid chamber limited by the piston.

19. Dispenser container according to claim 13, characterized in that the dispenser container comprises an outlet valve connecting the fluid chamber with an outside of the dispenser container.

20. Dispenser container according to claim 13, characterized in that a surface of the piston facing the partition wall has a shape at least partly corresponding to the contours of adjacent side of the partition wall.

21. Dispenser comprising a dispenser container according to claim 13, characterized in that the high-pressure chamber contains a propellant gas and in that the fluid chamber comprises a fluid to be dispensed.

* * * * *